United States Patent [19]

Gill

[11] Patent Number: 4,832,134

[45] Date of Patent: May 23, 1989

[54] SHAPED CHARGE ASSEMBLY WITH RETAINING CLIP

[75] Inventor: Bennie C. Gill, Arlington, Tex.

[73] Assignee: Jet Research Center, Inc., Mansfield, Tex.

[21] Appl. No.: 129,508

[22] Filed: Dec. 7, 1987

[51] Int. Cl.[4] ..... E21B 43/117

[52] U.S. Cl. ..... 175/4.6; 175/4.55; 102/310; 102/320

[58] Field of Search ..... 175/4.51, 4.53, 4.54, 175/4.55, 4.57, 4.58, 4.6; 102/310, 320; 89/1.15; 248/73, 74.2, 221.4, 316.7

[56] References Cited

U.S. PATENT DOCUMENTS

| | | | |
|---|---|---|---|
| 2,756,677 | 7/1956 | McCullough | 102/20 |
| 2,764,938 | 10/1956 | Harcus | 102/20 |
| 3,036,521 | 5/1962 | Owen | 175/4.6 |
| 3,197,167 | 7/1965 | Sturgis | 248/500 |
| 3,444,810 | 5/1969 | Hakala | 102/310 |
| 3,739,723 | 6/1973 | Hakala | 102/310 |
| 3,807,675 | 4/1974 | Seckerson et al. | 248/74.2 |
| 4,312,273 | 1/1982 | Camp | 102/310 |
| 4,326,462 | 4/1982 | Garcia et al. | 102/310 |
| 4,428,440 | 1/1984 | McPhee | 102/310 |
| 4,479,556 | 10/1984 | Stout et al. | 175/4.6 |
| 4,583,602 | 4/1986 | Ayers | 175/4.6 |
| 4,753,301 | 6/1988 | Berry | 175/4.6 |

*Primary Examiner*—Jerome W. Massie
*Assistant Examiner*—Terry Lee Melius
*Attorney, Agent, or Firm*—Wayne Beavers; Robert A. Kent

[57] ABSTRACT

A shaped charge assembly includes at least one shaped charge having an outer case. The case has a forward end and a rearward end, and has a flange defined thereon. A retaining clip is operably associated with the flange and spans the rearward end of the case for retaining a detonating cord. In an alternative embodiment, the retaining clip also serves to hold the shaped charge in place within a shaped charge carrier.

9 Claims, 4 Drawing Sheets

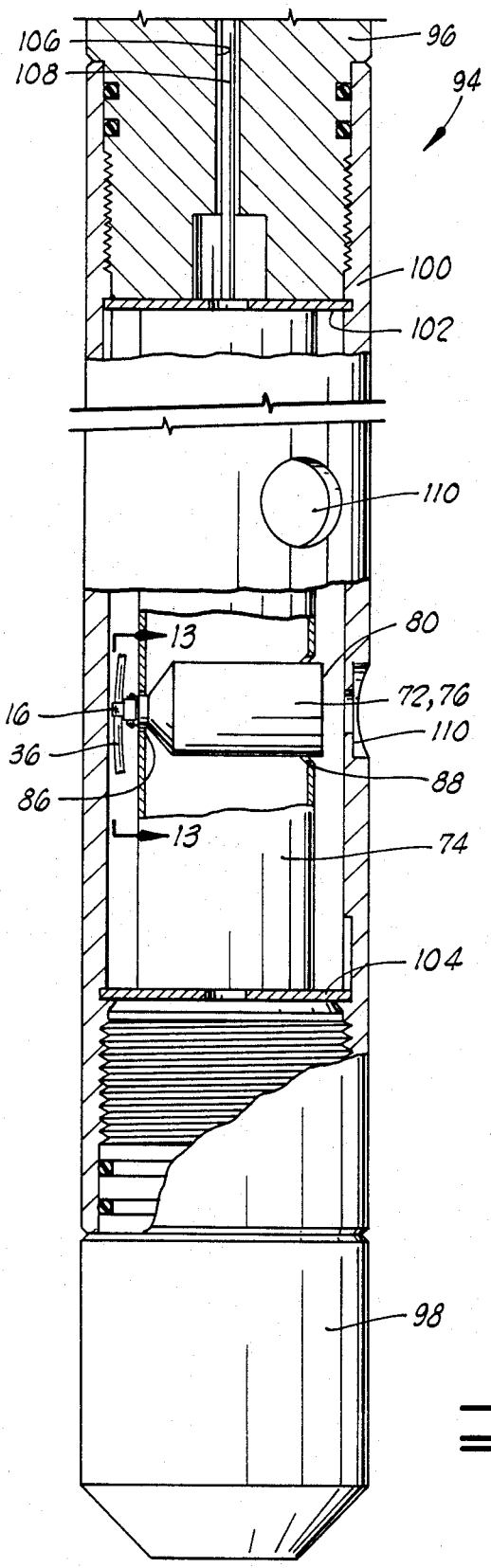
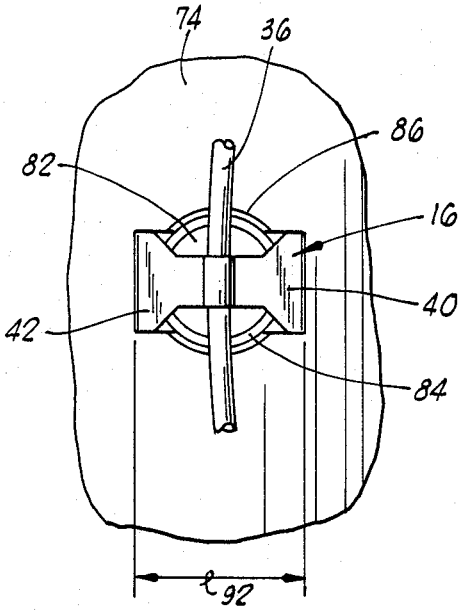
FIG. 13
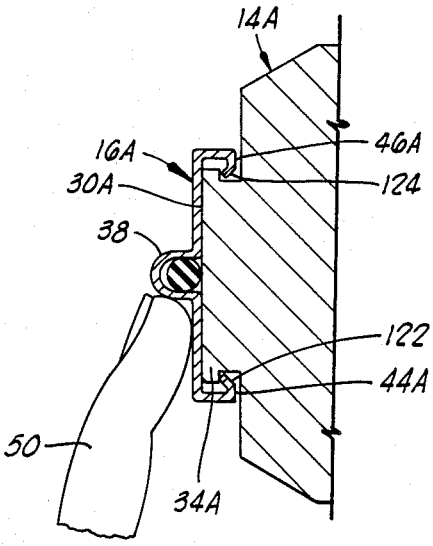
FIG. 14
FIG. 12

SHAPED CHARGE ASSEMBLY WITH RETAINING CLIP

BACKGROUND OF THE INVENTION

1. Field Of The Invention

The invention relates to shaped charges for use in an elongated perforating gun of the type generally used to perforate oil and gas wells. The invention particularly relates to a retaining clip for holding a detonating cord adjacent a rear end of a shaped charge. This same retaining clip may optionally be utilized to retain the shaped charge in place within a charge carrier.

2. Description Of The Prior Art

Perforating guns commonly used in wireline and tubing conveyed service operations for perforating an oil or gas well typically include an elongated carrier which has a number of shaped charges in place in the carrier. Typical carriers have included strip type carriers and tubular-type carriers. The carrier may be located within a housing which encloses the carrier and shaped charge assembly.

Retaining clip type structures have been utilized with such shaped charges to hold a detonating cord and/or to hold the shaped charge in place relative to a carrier.

U.S. Pat. No. 4,312,273 to Camp discloses a shaped charge mounting system including a spring wire clip 30 which holds the shaped charge in place and which includes arms which aid in holding a detonating cord.

U.S. Pat. No. 3,444,810 to Hakala discloses a shaped charge assembly including a swivel clamp base 38 which has a pair of resilient prongs 40 for holding a detonating cord.

U.S. Pat. Nos. 4,479,556 to Stout et al., 4,326,462 to Garcia et al. and 2,756,677 to McCullough disclose shaped charge assemblies including various types of attachment means for holding the shaped charge in place in a carrier.

U.S. Pat. Nos. 4,583,602 to Ayers and 2,764,938 to Harcus both disclose tubular type carriers in which shaped charges are held within pairs of diametrically opposed circular openings in the tubular carrier.

SUMMARY OF THE INVENTION

The shaped charge assembly of the present invention includes at least one shaped charge which has an outer case. The outer case has a forward end and a rearward end and has a flange defined thereon adjacent the rearward end. A retaining clip is operably associated with the flange and spans the rearward end of the case for retaining a detonating cord. Optionally, the retaining clip may also function to hold the shaped charge in place relative to a carrier. This second embodiment is particularly adapted to use with a tubular carrier in which the shaped charges are held within pairs of diametrically opposed circular openings.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 12 is an elevation partly sectioned view of an assembled perforating gun having a cylindrical thin wall tubular carrier and utilizing the shaped charge of FIGS. 9–11 with a retaining clip like that of FIGS. 3–8.

FIG. 13 is an enlarged elevation view showing how the retaining clip holds the shaped charge in place in the carrier of FIG. 12. The view of FIG. 13 is taken along line 13—13 of FIG. 12.

FIG. 14 is a view similar to FIG. 8 showing a first alternative embodiment of the retaining clip.

DETAILED DESCRIPTION OF THE INVENTION

The Embodiment of FIGS. 1–8

Figure 1:
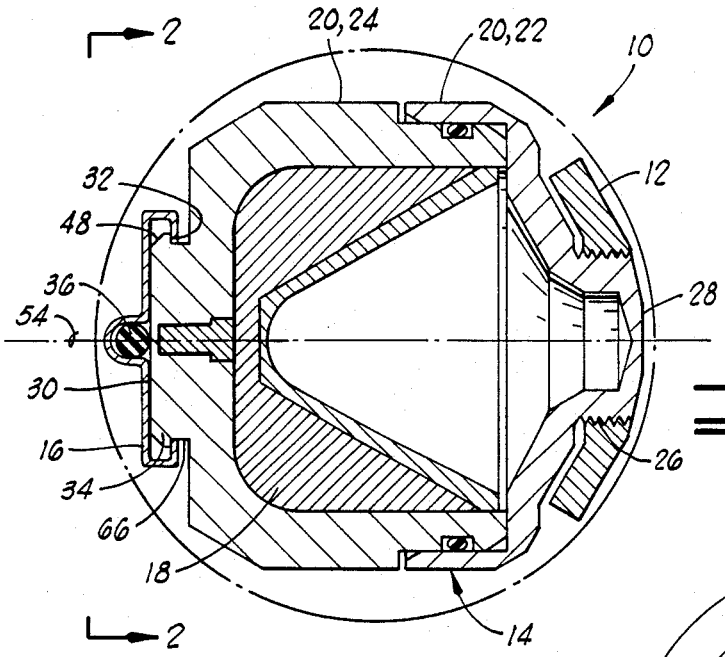
FIG. 1 is a plan section view of a shaped charge attached to a strip type carrier, and having a retaining clip holding a detonating cord adjacent a rear end of the shaped charge. The section of FIG. 1 is taken along line 1—1 of FIG. 2.

Referring now to the drawings, and particularly to FIG. 1, a shaped charge carrier assembly is thereshown and generally designated by the numeral 10.

The shaped charge carrier assembly 10 includes a strip type carrier 12, a shaped charge generally designated by the numeral 14, and a retaining clip means 16.

The internal details of the shaped charge 14 are not critical to the present invention, and thus will not be described in detail herein. The details illustrated in FIG. 1 are substantially similar to those disclosed in the application of Glenn B. Christopher entitled CAPSULE CHARGE LOCKING DEVICE filed on Oct. 5, 1987, as Application Ser. No. 106,472, and assigned to the assignee of the present invention, which is incorporated herein by reference.

The shaped charge 14 has a shaped explosive 18 therein which upon detonation will form a highly directional perforating explosive jet extending to the right in FIG. 1.

The shaped charge 14 has an outer case 20 including a forward portion 22 and a rearward portion 24.

The forward portion 22 of outer case 20 has a threaded neck 26 which is threadedly connected to the strip type carrier 12.

Case 20 has a forward end 28 and a rearward end 30. The case 20 also includes an annular forward facing surface 32. An annular flange 34 is defined between the rearward end 30 and the annular surface 32 of case 20.

Figure 2:
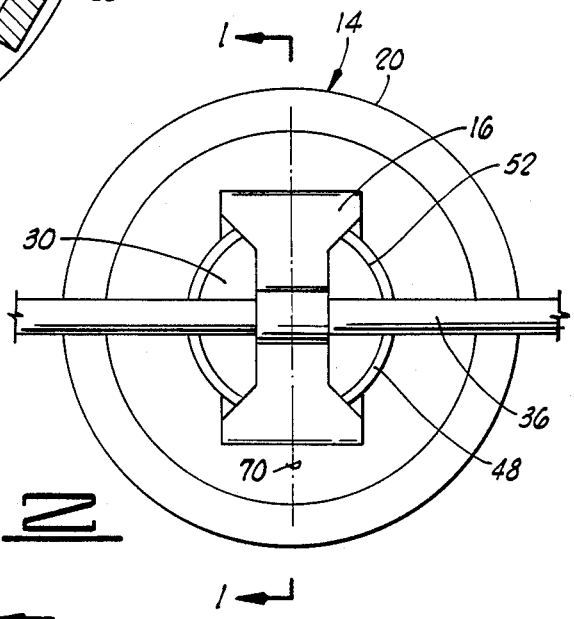
FIG. 2 is an end elevation view of the shaped charge of FIG. 1 taken along line 2—2 of FIG. 1.

The retaining clip means 16 is operably associated with the flange 34 and spans or extends across the rearward end 30 of case 20 as best seen in FIG. 2.

The retaining clip means 16 provides a means for retaining a detonating cord 36 against or very near the rearward end 30 of case 20 as best seen in FIG. 1.

The retaining clip means 16 includes a resiliently flexible U-shaped middle portion 38 open toward the case 20 for engaging the detonating cord 36. Retaining clip means 16 further includes first and second end clip portions 40 and 42, respectively, extending from the middle clip portion 38.

The first and second end clip portions 40 and 42 have first and second hook means 44 and 46, respectively, for engaging the annular forward facing surface 32 of case 20 and for thereby holding the retaining clip means 16 in place on case 20.

The resiliency of the U-shaped middle clip portion 38 permits the first and second hook means 44 and 46 to be spread apart to permit the flange 34 to be received therebetween. The manner in which this is accomplished is best seen with regard to the sequential series of FIGS. 6–8.

Figure 6:
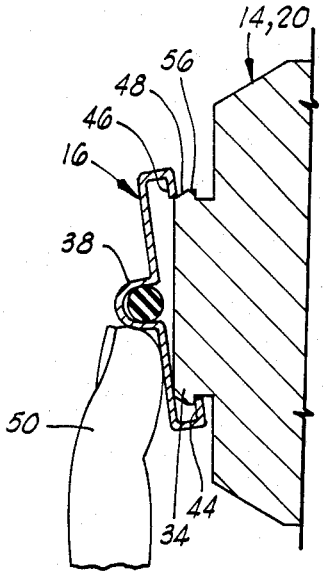
FIGS. 6, 7 and 8 are a sequential series of illustrations showing the retaining clip being placed over the flange of the shaped charge by a human thumb.
Figure 7:
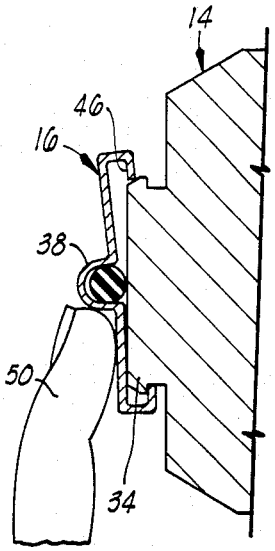
Figure 8:
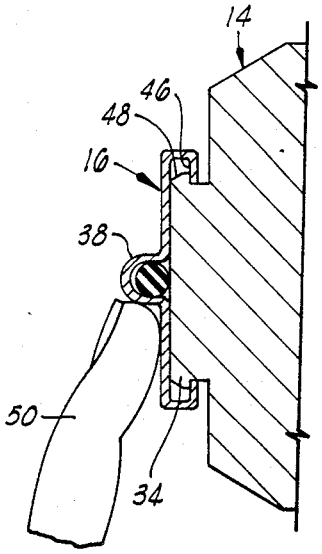

The flange 34 includes an annular rearward facing tapered cam surface means 48 for biasing the first and second hook means 44 and 46 apart when the first hook means 44 is placed over flange 34 as shown in FIG. 6, and the second hook means 46 is engaged with the tapered cam surface 48 and then forced in a forward direction as shown sequentially in FIGS. 6–8.

The first and second hook means 44 and 46 fit over an annular edge 56 of the flange 34. The annular edge 56 is shown in the preferred embodiments as being a very short cylindrical surface, but it will be understood that the annular edge 56 ma be defined by the forwardmost extremity of the tapered cam surface 48 if the tapered cam surface 48 extends completely between the rearward end 30 and the forward facing annular surface 32.

In FIGS. 6–8, a human thumb 50 is illustrated as applying the forward force necessary to spread the first and second hook means 44 and 46.

The first hook means 44 is placed over the flange 34 as shown in the lower portion of FIG. 6, and prior to the spreading of the clip means 16, the second hook means 46 will engage the case 20 of shaped charge 14 near the break line 52 (see FIG. 2) between the flat rearward end 30 and the tapered annular cam surface 48.

As illustrated in FIG. 6, the retaining means 16 has a normal unflexed position in which a distance between the first and second hook means 44 and 46 is less than an outside diameter of the flange 34 so that the flange 34 cannot be received between the hook means 44 and 46 until the hook means 44 and 46 are spread apart.

Then the thumb 50 is engaged with the U-shaped middle portion 38, and a force is exerted against the retaining clip means 16 toward the shaped charge 14 and to some extent away from the first hook means 44.

As the second hook means 46 is forced forward along the tapered cam surface 48, the cam surface 48 cams the second hook means 46 radially outward as seen in FIG. 7. This radially outward movement of second hook means 46 away from first hook means 44 is allowed by the resiliency of the U-shaped middle portion 38 of clip 16.

Once the second hook means 46 passes over the annular edge 56 of flange 34, the resiliency of the middle portion 38 of clip means 16 causes the second hook means 46 to snap back toward its original position behind the flange 34 as seen in FIG. 8.

Figure 9:
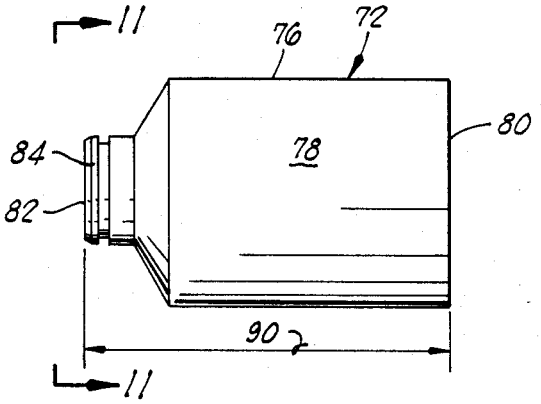
FIG. 9 is a side view of a shaped charge designed for use in a cylindrical thin wall tubular carrier and for use with a retaining clip like that of FIGS. 3–8.
Figure 11:
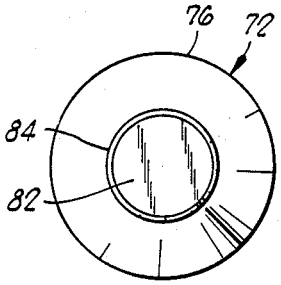
FIG. 11 is an end elevation view taken along line 11—11 of the shaped charge of FIG. 9.
Figure 10:
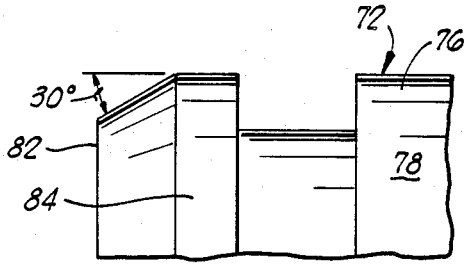
FIG. 10 is an enlarged view of a portion of the shaped charge of FIG. 9 adjacent the upper rearward end to illustrate the angle on the tapered annular cam surface.

The tapered annular cam surface 48 preferably is tapered at an angle of about 30° to a longitudinal axis 54 of shaped charge 14. This angle is best illustrated in the enlarged view of FIG. 10 which shows the similarly shaped flange on the alternative shaped charge of FIG. 9.

Figure 3:
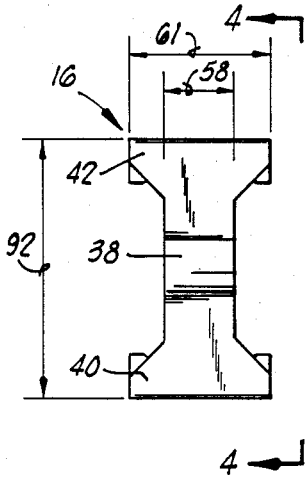
FIG. 3 is a rear elevation view of the retaining clip.
Figure 4:
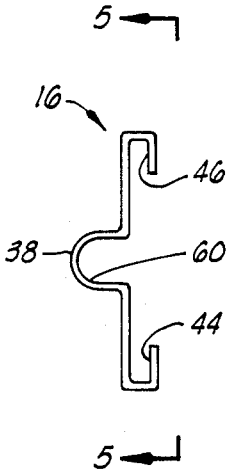
FIG. 4 is an end view of the retaining clip of FIG. 3 taken along line 4—4 of FIG. 3.
Figure 5:
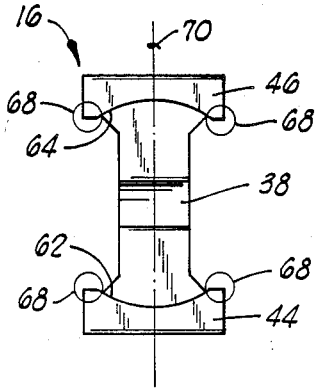
FIG. 5 is a front view of the retaining clip of FIGS. 3 and 4, taken along line 5—5 of FIG. 4.

The construction of the retaining clip means 16 is best seen in FIGS. 3–5.

The retaining clip means 16 is preferably integrally constructed from a thin sheet of material such as steel.

As seen in FIG. 4, the thin sheet of material has been deformed in a central location to form the U-shaped middle portion 38 which gives the clip its flexibility, and has been deformed at its ends to form the first and second hook means 44 and 46.

When the term "U-shaped" is used to describe the middle portion 38, it will be understood that this term is being used only in a general sense and that it is not actually required that the middle portion 38 be formed in a continuous curve like the letter "U" as has been shown. The U-shaped middle portion 38 could, for example, be formed with three relatively flat sides like the three sides of a rectangle.

As best seen in FIGS. 3 and 5, the U-shaped middle portion 38 has a reduced width 58 parallel to a longitudinal axis of the trough 60 thereof. This reduced width 58 of middle portion 38 is less than a parallel width 61 of the first and second hook means 44 and 46. This reduced width 58 of middle portion 38 determines in part the flexibility of the middle portion 38 of the clip means 16.

As bet seen in FIG. 5, the underturned sheet metal lips defining the first and second hook means 44 and 46 have arcuate edges 62 and 64 formed thereon defining portions of a circle having a diameter equal to or slightly less than an outside diameter of a necked-down cylindrical outer surface 66 (see FIG. 1) of case 20. These arcuate edges 62 and 64 prevent the retaining clip 16 from sliding off the annular flange 34.

When the retaining clip means 16 is in place about the flange 34 as shown in FIGS. 1 and 8, each of the first and second hook means 44 and 46 will engage the annular forward facing surface 32 of case 20 at at least two points in the areas generally designated as 68 on FIG. 5. These two points of each of the hook means 44 and 46 will lie on opposite sides of an imaginary diametrical line 70 across the annular flange 34.

The Embodiment Of FIGS. 9–13

Turning now to FIGS. 9–13, an alternative embodiment of the present invention is thereshown. The embodiment of FIGS. 9–13 utilizes the identical retaining clip 16 of FIGS. 3–8, in combination with a modified shaped charge 72 and a thin wall cylindrical tubular carrier 74.

With the embodiment of FIGS. 9–12, the retaining clip 16 serves an additional function, namely that of retaining the shaped charge 72 in place within the carrier 74 as is best seen in FIG. 13.

The shaped charge 72 includes an outer case 76 having a generally cylindrical outer surface 78 and having a forward end 80 and a rearward end 82.

The case 76 has an annular flange 84 defined thereon adjacent the rearward end 82. The annular flange 84, as is apparent in FIG. 9, has an outside diameter substantially less than the outside diameter of the forward end 80 of case 76.

The annular flange 84 is constructed in a manner substantially identical to the flange 34 previously described.

The cylindrical tubular thin wall carrier 74 of FIG. 12 includes first and second diametrically opposed substantially circular charge openings 86 and 88 for receiving the shaped charge 72 therein.

The first charge opening has a diameter slightly larger than the outside diameter of the annular flange 84 but smaller than the outside diameter of the forward end 80 of case 76 whereby the flange 84 may pass through the first charge opening 86 as seen in FIGS. 12 and 13.

The second charge opening 88 has a diameter greater than the outside diameter of the forward end 80 of case 76. As best seen in FIG. 12, the outside diameter of the cylindrical tubular carrier 74 is less than a length 90 (see FIG. 9) of case 76 so that the case 76 is received within the first and second charge openings 86 and 88.

The first and second end portions 40 and 42 of the retaining clip means 16 extend radially beyond the flange 84 a sufficient distance to prevent the flange 84 from passing back through the first charge opening 86 as best seen in FIG. 13. In other words, a length 92 of retaining clip means 16 is greater than a diameter of the first substantially circular charge opening 86.

Thus, to assemble the shaped charge 72 with the carrier 74, the rearward end 82 of shaped charge 72 is first inserted through the second charge opening 88, and then through the first charge opening 86 into a position such as that shown in FIG. 12. Then, the detonating cord 36 is placed adjacent the rearward end 82 of shaped charge 72, and the retaining clip means 16 is engaged with the detonating cord 36 and then snapped in place over the annular flange 84 in the manner such as described with regard to FIGS. 6–8.

FIG. 12 further illustrates the surrounding structure of a perforating gun 94. The gun 94 includes an upper plug 96, and a lower plug 98, which are connected by a relatively thick wall cylindrical outer housing 100.

The cylindrical thin wall carrier 74 is held in place in housing 100 between upper and lower mounting plates 102 and 104.

Disposed through a central opening 106 of upper plug 96 is a firing means 108 which generally comprises a length of detonating cord and associated apparatus for firing the shaped charges such as 72. The firing means 108 is connected to the detonating cord 36 previously described.

The shaped charges 72 are fired in response to an electrical signal directed down a wireline (not shown) from a surface location at the top of the oil well which is being perforated.

The housing 100 includes reduced thickness areas 110 which are located so as to be immediately adjacent a forward end 80 of one of the shaped charges 72.

Although only a single shaped charge 72 is shown in FIG. 12, it will be understood that a plurality of such shaped charges will generally be contained by the carrier 74 and arranged in any desired pattern, with the detonating cord 36 connecting each of the shaped charges to the firing means 108.

The Embodiments Of FIGS. 14–17

Figure 15:
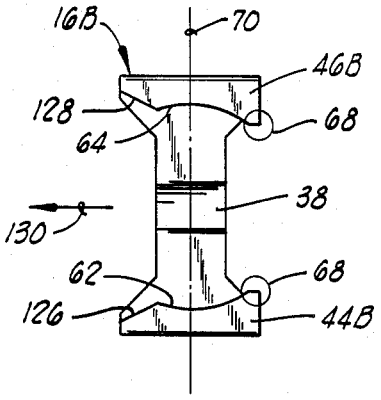
FIG. 15 is a view similar to FIG. 5 showing a second alternative embodiment of the retaining clip.
Figure 16:
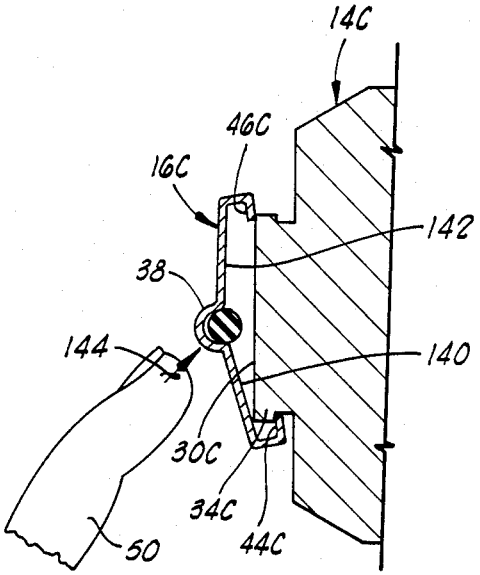
FIGS. 16 and 17, are sequential views similar to FIGS. 6 and 8 showing a third alternative embodiment of the retaining clip.
Figure 17:
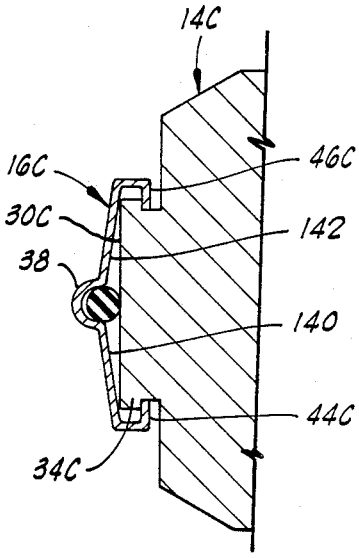

Referring now to FIGS. 14–17, three alternative embodiments of the retaining clip 16 are thereshown and designated as 16A (FIG. 14), 16B (FIG. 15), and 16C (FIGS. 16–17). In the three alternative embodiments of FIGS. 16A, 16B and 16C, a tapered cam surface means has been incorporated in the clip itself thus eliminating the need for the tapered surface 48 such as seen in FIG. 1.

FIG. 14 is a view similar to FIG. 8, showing the first modified retaining clip 16A in which the hook means 44A and 46A each have angular turned-in portions 122 and 124, respectively, which define forward facing tapered cam surface means 122 and 124.

As is apparent in FIG. 14, the flange 34A does not have the annular tapered surface 48 like shown in the embodiment of FIG. 1, but instead has a squared-off shoulder on its rearward end 30A. The tapered cam surface means 122 and 124 defined on retaining clip means 16A engage the squared outer edge of rear end 30A of shaped charge 14A for biasing the first and second hook means 44A and 46A of the retaining clip means 16A apart as the retaining clip means 16A is engaged with the outer case of the shaped charge in a manner like that previously illustrated in FIGS. 6–8.

The alternative embodiment of FIG. 16B is designed to be assembled with a shaped charge like that shown in either FIGS. 1 or 14, by sliding the retaining clip means 16B in a direction parallel to a plane of the flange 34.

Thus, the retaining clip means 16B has been provided with tapered cam surface means 126 and 128 which are designed to be engaged with the necked-down surface 66 (see FIG. 1) of shaped charge 14 and then to bias the first and second hook means 44B and 46B apart as the retaining clip means 16B is engaged with and pressed against the neckeddown portion 66 of shaped charge 14 in a direction generally indicated by the arrow 130 set forth on FIG. 15.

Referring now to FIGS. 16 and 17, yet another alternative embodiment of the retaining clip means 16C is thereshown. The retaining clip means 16C is also designed for use with a flange 34C having a squared-off shoulder on its rearward end 30C.

The retaining clip means 16C has first and second tapered cam surface means 140 and 142 defined on the end clip portions which extend outward from the U-shaped metal portion 38.

The tapered cam surface means 140 and 142 defined on the end clip portions are generally planar and lie at a shallow angle to a plane of the annular flange 34C as seen in FIG. 17, so that the tapered cam surface means 140 and 142 must be somewhat flattened toward the annular flange 34C to spread the first and second hook means 44C and 46C over the annular edge of flange 34C.

As shown in FIG. 16, the retaining clip means 16C is assembled with the shaped charge 14C by placing the first hook means 44C over the flange 34C, and then pressing in a direction generally indicated by the arrow 144 against the retaining clip means 16C to cause the first and second hook means 44 and 46 to spread apart with the second hook means 46C then snapping back under the flange 34C as seen in FIG. 17.

Accordingly, in generally describing the concept of the retaining clip means of the present invention it can be said that one of the outer case 20 and the retaining clip means includes a tapered cam surface means for biasing the first and second hook means apart as the retaining clip means is engaged with the outer case.

In the embodiments of FIGS. 1–8, this tapered cam surface means is the surface 48 defined on a flange of the outer case 20.

In the embodiment of FIG. 14, this tapered cam surface means is the portions 122 and 124 defined on the retaining clip means 16A.

In the embodiment of FIG. 15, this tapered cam surface means includes the surfaces 126 and 128 defined on the hook means 44B and 46B.

In the embodiment of FIGS. 16 and 17 this tapered cam surface means includes the surfaces 140 and 142 defined on the retaining clip means 16C.

Thus it is seen that the apparatus of the present invention readily achieves the ends and advantages mentioned as well as those inherent therein. While certain preferred embodiments of the invention have been illustrated and described for the purposes of the present disclosure, numerous changes in the arrangement and construction of parts may be made by those skilled in the art, which changes are encompassed within the scope and spirit of the invention as defined by the appended claims.

What is claimed is:

1. A shaped charge assembly for use in a perforating gun, comprising:

at least one shaped charge including an outer case, said case having a rearward end and having an annular forward facing surface defined on said case near said rearward end, thereby defining an annular flange between said rearward end and said annular forward facing surface;

retaining means, attachable to said annular flange, said retaining means being integrally constructed from a thin sheet of material and having a U-shaped middle portion open toward said case for holding a detonating cord and having first and second end portions extending from said middle portion, said first and second end portions having first and second hook means, respectively, for fitting over an annular edge of said flange;

wherein said U-shaped middle portion of said retaining means is resiliently flexible so that said first and second hook means may be spread apart, and said retaining means has a normal unflexed position in which a distance between said first and second hook means is less than an outside diameter of said flange; and wherein said U-shaped middle portion has a reduced width parallel to a rough thereof, less than a parallel width of each of said first and second hook means, said reduced width determining a flexibility of said U-shaped middle portion.

2. The assembly of claim 1, wherein:

one of said outer case and said retaining means includes a tapered cam surface means for biasing said first and second hook means apart as said retaining means is engaged with said outer case.

3. The assembly of claim 2, wherein:

said tapered cam surface means is defined on said flange of said outer case and is further characterized as a rearward facing tapered cam surface means for biasing said first and second hook means apart when said first hook means is placed over said flange and said second hook means is engaged with said tapered cam surface and forced in a forward direction.

4. The assembly of claim 3, wherein:

said tapered cam surface is tapered at an angle of about 30° to a longitudinal axis of said shaped charge.

5. The assembly of claim 1, wherein:

each of said first and second hook means engages said annular forward facing surface at at least two points on opposite sides of an imaginary diametrical line across said annular flange.

6. The assembly of claim 2, wherein:

said tapered cam surface means is defined on said retaining means.

7. The assembly of claim 6, wherein:

said first and second hook means each include an angular turned-in portion thereof defining said tapered cam surface means.

8. The assembly of claim 6, wherein:

said first and second hook means have said tapered cam surface means defined thereon, said tapered cam surface means being further defined as a means for biasing said first and second hook means apart as said retaining means is engaged with a necked-down portion of said outer case forward of said annular flange and as said retaining means is pressed against said necked-down portion in a direction generally parallel to a plane of said annular flange.

9. The assembly of claim 6, wherein:

said tapered cam surface means is defined on said first and second end portions of said retaining means, said first and second end portions being generally planar and each lying at a shallow angle to a plane of said annular flange so that said first and second end portions must be somewhat flattened toward said annular flange to spread said first and second hook means over said annular edge of said flange.

* * * * *